US009212667B2

(12) United States Patent
Sun et al.

(10) Patent No.: US 9,212,667 B2
(45) Date of Patent: Dec. 15, 2015

(54) VARIABLE-SPEED OIL-FREE REFRIGERANT CENTRIFUGAL COMPRESSOR WITH VARIABLE GEOMETRY DIFFUSER

(75) Inventors: Lin Sun, Tallahassee, FL (US); Joost Brasz, Fayetteville, NY (US)

(73) Assignee: DANFOSS A/S, Nordborg (DK)

( * ) Notice: Subject to any disclaimer, the term of this patent is extended or adjusted under 35 U.S.C. 154(b) by 358 days.

(21) Appl. No.: 13/699,114

(22) PCT Filed: Dec. 22, 2010

(86) PCT No.: PCT/US2010/061754
§ 371 (c)(1),
(2), (4) Date: Nov. 20, 2012

(87) PCT Pub. No.: WO2012/087306
PCT Pub. Date: Jun. 28, 2012

(65) Prior Publication Data

US 2013/0064682 A1 Mar. 14, 2013

(51) Int. Cl.
*F04D 29/46* (2006.01)
*F04D 29/44* (2006.01)
*F04D 15/00* (2006.01)

(52) U.S. Cl.
CPC ..... *F04D 29/464* (2013.01); *F04D 15/00* (2013.01); *F04D 29/444* (2013.01); *F04D 29/462* (2013.01)

(58) Field of Classification Search
CPC ..... F04D 29/464; F04D 29/5846; F04D 27/0207; F04D 29/462; F04D 29/466
USPC ..... 417/420, 423.12
See application file for complete search history.

(56) References Cited

U.S. PATENT DOCUMENTS 3,478,955 A * 11/1969 Kunderman ..... 417/507
4,378,194 A * 3/1983 Bandukwalla ..... 415/49
5,669,756 A 9/1997 Brasz et al.
5,807,071 A 9/1998 Brasz et al.
5,924,847 A 7/1999 Scaringe et al.

(Continued)

OTHER PUBLICATIONS

International Preliminary Report on Patentability for International Application No. PCT/US2010/061754 mailed Jul. 4, 2013.
International Search Report for PCT Application No. PCT/US10/61754, Mar. 7, 2011.

(Continued)

*Primary Examiner* — Charles Freay
*Assistant Examiner* — Kenneth J Hansen
(74) *Attorney, Agent, or Firm* — Carlson, Gaskey & Olds, P.C.

(57) ABSTRACT

A refrigerant compressor includes a housing providing a refrigerant outlet having a throat. An electric motor is provided in the housing to directly drive an impeller via a shaft about an axis in response to a variable speed command. The impeller includes an outlet end aligned with variable geometry diffuser. A magnetic bearing assembly rotationally supports the shaft relative to the housing in response to a magnetic bearing command. A member is arranged to adjust the throat area, and which can move in a direction generally parallel to the axis in response to an actuator receiving a compressor regulation command. A controller is configured to respectively provide the variable speed command, the magnetic bearing command and the compressor regulation command to the electric motor to vary throat area, the magnetic bearing assembly and the actuator to obtain a desired compressor operation without the need of variable inlet geometry.

8 Claims, 3 Drawing Sheets

(56) References Cited

U.S. PATENT DOCUMENTS

| | | | | |
|---|---|---|---|---|
| 2002/0176774 | A1* | 11/2002 | Zinsmeyer et al. | 415/150 |
| 2002/0184905 | A1* | 12/2002 | Benedict et al. | 62/228.4 |
| 2004/0109757 | A1* | 6/2004 | Nenstiel | 415/151 |
| 2005/0076656 | A1* | 4/2005 | Bodell et al. | 62/83 |
| 2010/0263391 | A1 | 10/2010 | Tetu et al. | |

OTHER PUBLICATIONS

Sishtla, Vishnu., "Performance of Centrifugal Compressors With Variable Vaned Diffuser," Carrier Corporation, Syracuse, NY, pp. 767-773.

* cited by examiner

VARIABLE-SPEED OIL-FREE REFRIGERANT CENTRIFUGAL COMPRESSOR WITH VARIABLE GEOMETRY DIFFUSER

BACKGROUND

This disclosure relates to a refrigerant compressor with a magnetic bearing assembly and a variable speed electric motor. More particularly, the disclosure relates to such a refrigerant compressor having a variable geometry diffuser.

Refrigerant compressors are used to circulate refrigerant to a chiller via a refrigerant loop. One type of typical refrigerant compressor operates at fixed speed and has a set of variable inlet guide vanes arranged upstream from the impeller. The variable inlet guide vanes are actuated during operation of the refrigerant compressor to regulate its capacity during various operating conditions.

Some fixed speed refrigerant compressors have additionally employed a variable-geometry diffuser downstream from the compressor to improve capacity control during the various operating conditions.

Fixed-speed centrifugal compressors benefit from having both a variable-geometry diffuser and variable-geometry inlet guide vanes. Compressor part-load efficiency and stable operating range both improve. For fixed-speed centrifugal compressors stable operating range is limited without the addition of a variable-geometry diffuser while off-design efficiency suffers without the addition of a set of inlet guide vanes.

This disclosure describes a centrifugal compressor capacity control apparatus and method using a variable-speed compressor with a variable-geometry diffuser that improves the stable operating range or turn-down capability of the compressor and results in higher compressor efficiency than a variable speed compressor with inlet guide vanes.

SUMMARY

A refrigerant compressor includes a housing providing space for a diffuser and volute downstream of the impeller. An electric motor is provided in the housing and is configured to directly drive an impeller via a shaft about an axis in response to a variable speed command. The impeller includes an outlet end that is aligned with the diffuser. A magnetic bearing assembly is configured to rotationally support the shaft relative to the housing in response to a magnetic bearing control command. A variable geometry member is arranged in the diffuser downstream of the impeller.

The variable geometry member can be configured in various ways, for example, the variably geometry member moves linearly in a direction generally parallel to the axis in response to an actuator receiving a compressor regulation command. The variable geometry member can also be configured in a variety of other ways.

A controller is in communication with the electric motor, the magnetic bearing assembly and the variable geometry diffuser actuator. The controller is configured to respectively provide the variable speed command, the magnetic bearing command and the compressor regulation command to the electric motor to vary its speed, to the magnetic bearing assembly to position the shaft, and to the diffuser actuator to vary its throat area in order to obtain a desired compressor operation.

BRIEF DESCRIPTION OF THE DRAWINGS

The disclosure can be further understood by reference to the following detailed description when considered in connection with the accompanying drawings wherein.

DETAILED DESCRIPTION

Figure 1:
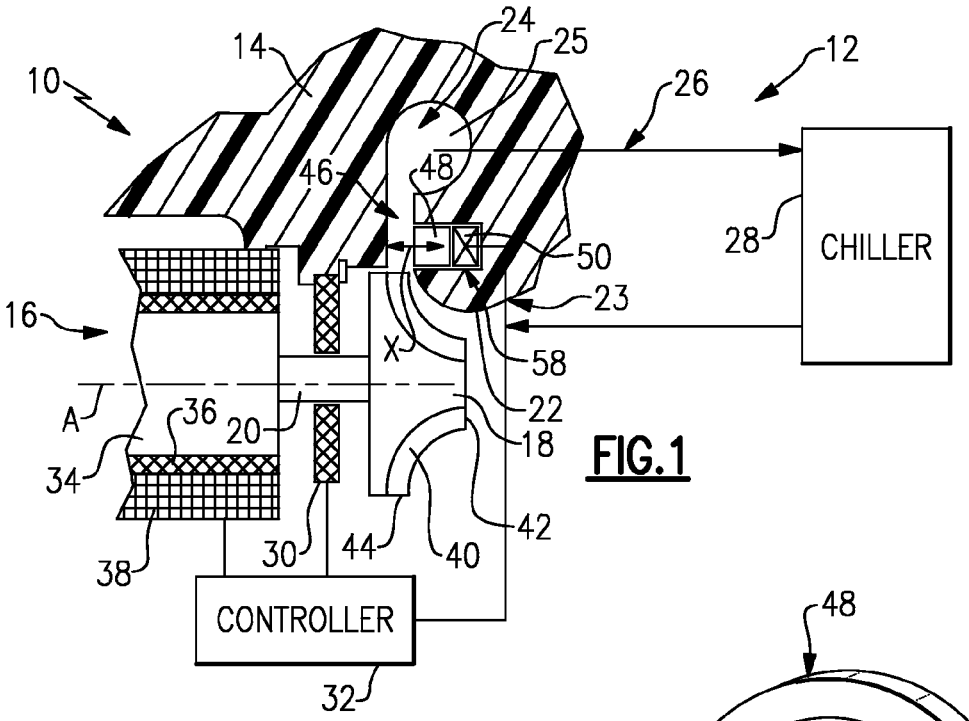
FIG. 1 is a highly schematic view of a refrigerant system having a refrigerant compressor with a magnetic bearing.

Referring to FIG. 1, a refrigeration system 12 includes a refrigerant compressor 10 for circulating a refrigerant. The refrigerant compressor 10 includes a housing 14 within which an electric motor 16 is arranged. The housing 14 is schematically depicted and may comprise one or more pieces. The electric motor 16 rotationally drives an impeller 18 via a shaft 20 about an axis A to compress the refrigerant.

The impeller 18 includes a refrigerant inlet 42 and a refrigerant outlet 44 in fluid communication with a refrigerant loop 26 that circulates the refrigerant to a load, such as a chiller 28. In the example illustrated in FIG. 1, the compressor contains the impeller 18, which is centrifugal. That is, the refrigerant inlet 22 is arranged axially, and the refrigerant outlet 24 is arranged radially. The refrigerant loop 26 includes a condenser, an evaporator, and an expansion device (not shown).

An oil-free bearing arrangement is provided for support of the shaft 20 so that oil-free refrigerant can be used in the refrigerant compressor 10. In the example, the shaft 20 is rotationally supported relative to the housing 14 by a radial magnetic bearing assembly 30. The magnetic bearing assembly 30 may include radial and/or axial magnetic bearing elements, for example. A controller 32 communicates with the magnetic bearing assembly 30 providing a magnetic bearing command to energize the magnetic bearing assembly 30. The magnetic bearing assembly creates a magnetic field levitating the shaft 20 and controls its characteristics during operation of the refrigerant compressor 10. The controller 32 is depicted schematically, and may include multiple controllers that are located remotely from or near to one another. The controller 32 may include hardware and/or software.

The electric motor 16 includes a rotor 34 supporting multiple magnets 36 about its circumference in one example. A stator 38 is arranged about the rotor 34 to impart rotational drive to the shaft 20 when energized. In one example, the controller 32 communicates with the stator 38 and provides a variable speed command to rotationally drive the impeller 18 at a variable speed depending upon compressor operating conditions. The controller 32 communicates with multiple sensors (not shown) to monitor and maintain the compressor operating conditions.

The impeller 18 includes blades 40 that extend from an inlet end 42 generally radially outwardly along an arcuate path to an outlet end 44. The housing 14 includes an upstream region 23 at the refrigerant inlet 22, which has typically contained variable inlet guide vanes in the prior art. The refrigerant compressor 10 does not utilize variable inlet guide vanes at the upstream region 23 in the illustrated embodiment. Instead, a variable geometry member 48 is provided downstream from the outlet end 44 to regulate the flow and pressure across the impeller 18 without the need for or use of inlet guide vanes.

Figure 3A:
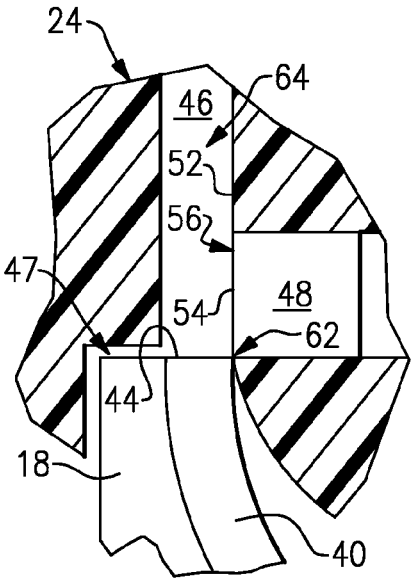
FIG. 3A is an enlarged, cross-sectional view of the variable geometry member in a generally unrestricted condition.
Figure 3B:
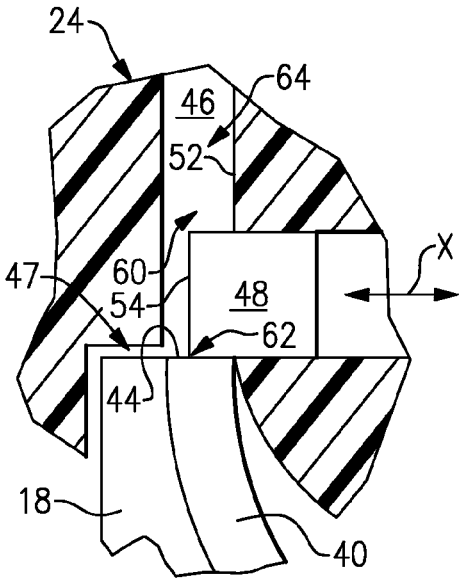
FIG. 3B is an enlarged, cross-sectional view of the variable geometry member in a restricted condition.

The refrigerant outlet 24 includes a passage 46 having a throat 47, which is the smallest cross-sectional flow area, immediately adjacent to the outlet end 44, as best illustrated in FIGS. 3A and 3B. The passage 46 extends to a volute 25. In the example shown, the variable geometry member 48 is provided at the throat 47 adjacent to a corner 62 of the blade 40 at the inlet end 42 and axially aligned with at least a portion of the impeller 18 and radially outward of the outlet end 44. In one example, the passage 46 is without additional structures or vanes, providing a "vaneless" diffuser in a downstream region 64 between the variable geometry member 48 and the volute 25. An actuator 50 is provided in a cavity 58 of the housing 14, for example, to move the variable geometry member 48 between unrestricted (FIG. 3A) and restricted (FIG. 3B) conditions.

Figure 2:
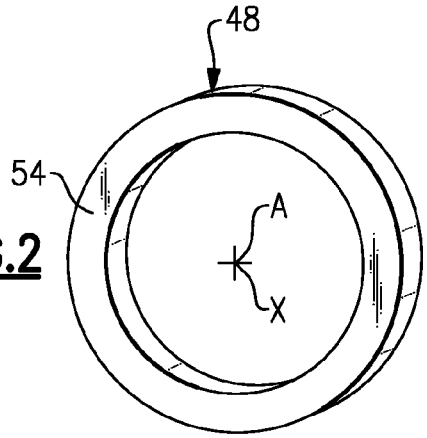
FIG. 2 is a perspective view of one example variable geometry member.

The passage 46 includes a wall 52 that provides a contour along with an outer surface 54 of the variable geometry member 48. In one example, the variable geometry member 48 is provided by a ring, shown in FIG. 2, which is generally continuous about its circumference in one example. An uninterrupted contour 56 is, provided when the wall 52 immediately adjoins the surface 54 in a generally unrestricted condition, as shown in FIG. 3A. Flow exiting the inlet end 42 enters the passage 46 generally uninhibited by the variable geometry member 48 in the unrestricted condition.

The variable geometry member 48 is illustrated in a restricted condition in FIG. 3B. The variable geometry member 48 is moved between the unrestricted condition and restricted conditions in response to a compressor regulation command to an actuator 50 from the controller 32 to vary the throat area. The variable geometry member 48 has been moved in a direction X, which is generally parallel to the rotational axis A, as compared to the variable geometry member's position in the unrestricted condition illustrated in FIG. 3A. The restricted condition creates an interrupted contour 60 in which the wall 52 and the surface 54 are interrupted and disjointed relative to one another, thereby inhibiting flow from the inlet end 42 into the passage 46.

A vaneless variable geometry arrangement is depicted in FIGS. 3A-3B. Different variable geometry arrangements using vanes, which may be used in the refrigerant system 12, are shown in FIGS. 4-8.

Figure 4:
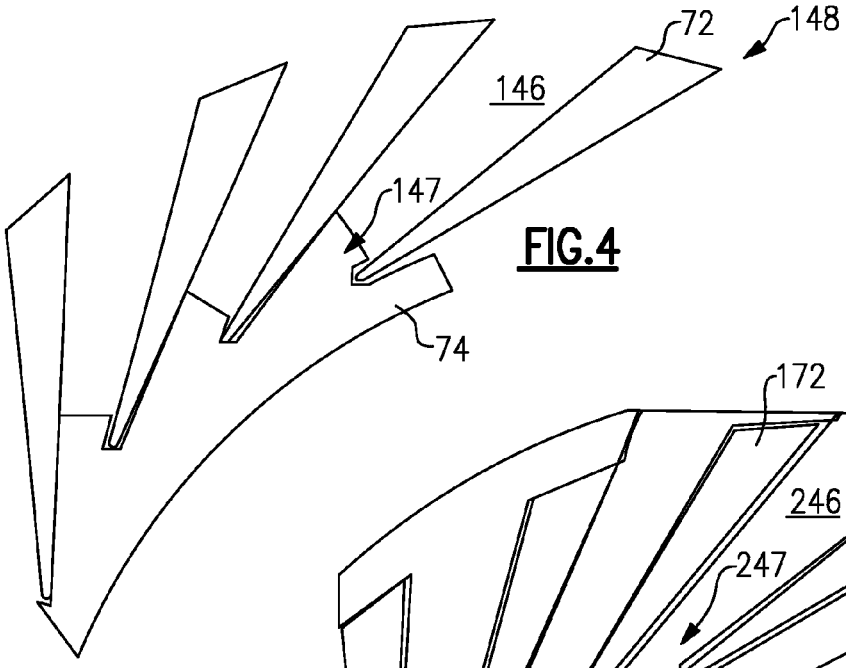
FIG. 4 is a schematic view of a portion of another variable geometry arrangement.

Referring to FIG. 4, an example variable geometry arrangement 148 includes circumferentially arranged vanes 72 disposed in the refrigerant outlet to provide circumferentially spaced passages 146. A throat 147 is provided in each of the passages 146 at the smallest area between adjacent vanes 72. An axially movable member 74 is arranged downstream from the impeller 18, and in the example, extend into the throat 147 a distance into the passage 146. The member 74 is moved by an actuator, in a manner similar to that described above with respect to member 48, to control the flow of refrigerant through the refrigerant outlet.

Figure 5:
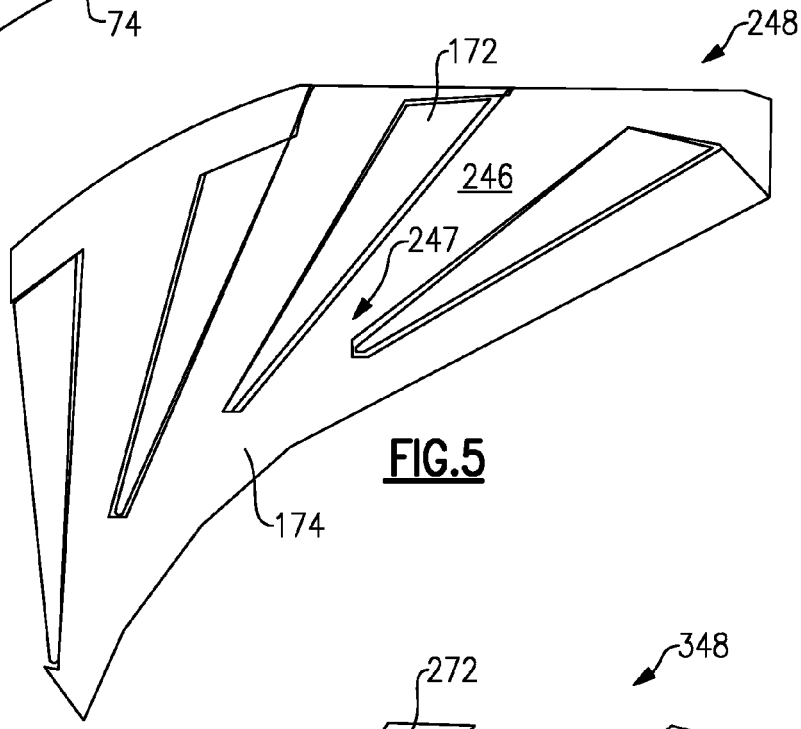
FIG. 5 is a schematic view of a portion of yet another variable geometry arrangement.

A similar variable geometry arrangement 248 is shown in FIG. 5. In this example, the axially movable member 174 surrounds each vane 172 such that the member 174 is provided along the entire passage 246 so the area of the passage 246 is varied along with the area of the throat 247.

Figure 6:
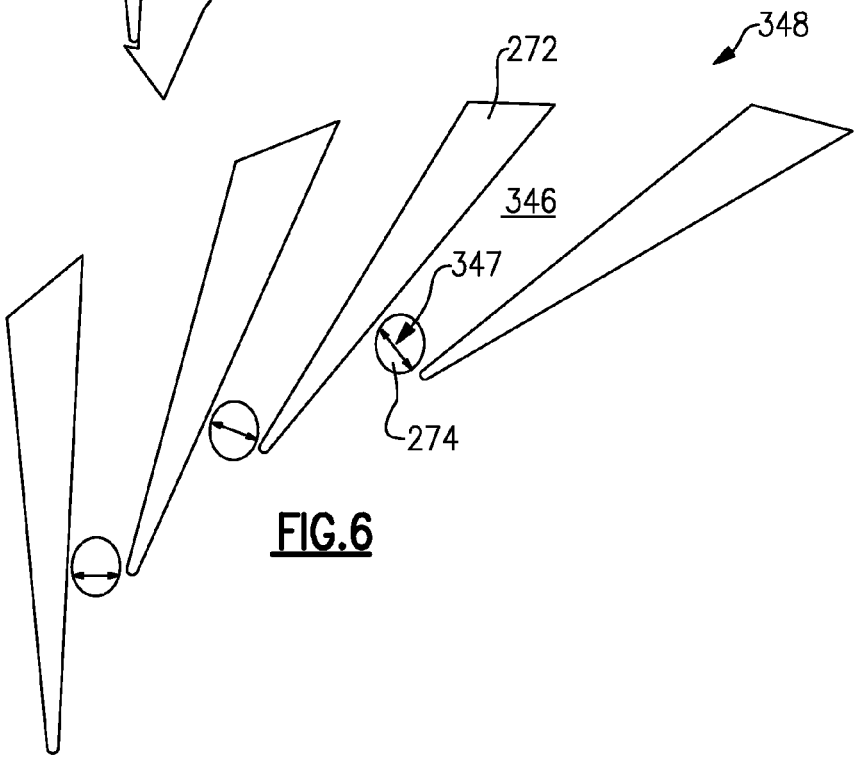
FIG. 6 is a schematic view of a portion of another variable geometry arrangement.

Referring to FIG. 6, the variable geometry arrangement 348 includes circumferentially spaced passages 346. The axially movable member 274 is arranged at the throat 347, but does not wrap about the leading edges of the vanes 272 as do the members 74, 174 illustrated in FIGS. 4 and 5.

Figure 7:
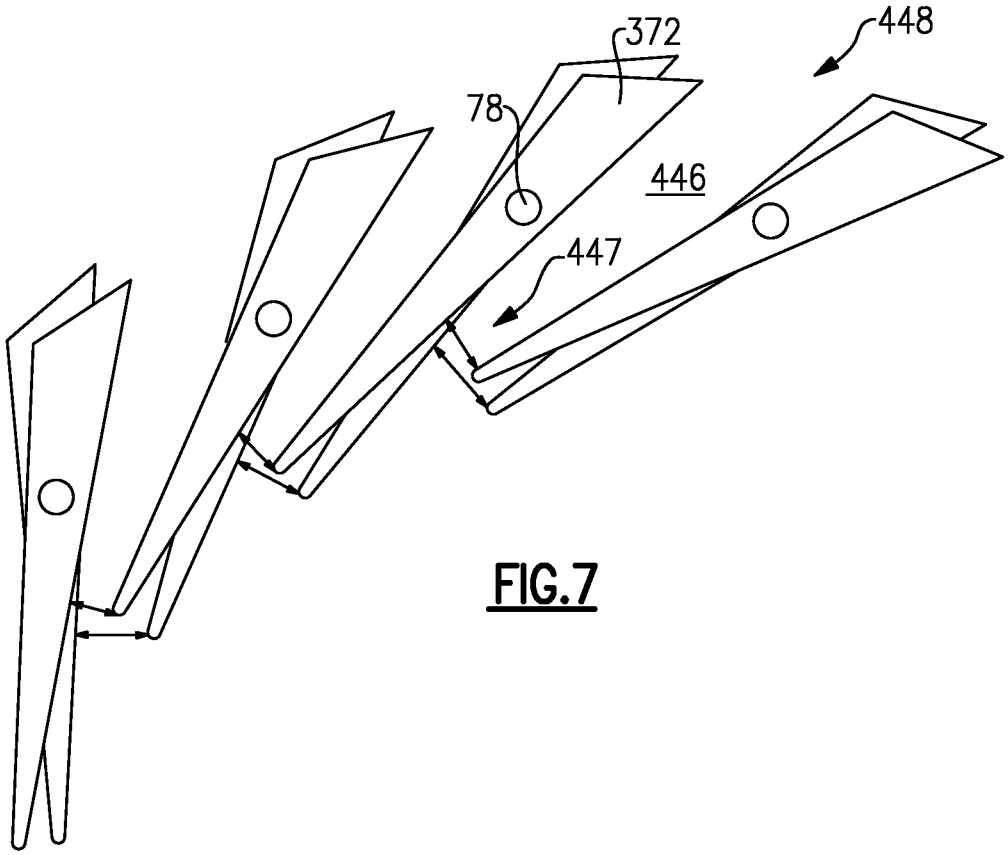
FIG. 7 is a schematic view of a portion of still another variable geometry arrangement.

FIG. 7 illustrates a variable geometry arrangement 448 depicting vanes 372 that are rotatable between multiple positions (two shown in FIG. 7) about pivots 78, which provide axes of rotation normal to the diffuser side walls. Rotation of the vanes 372 adjusts the throat 447 and flow of refrigerant into the passages 446.

Figure 8:
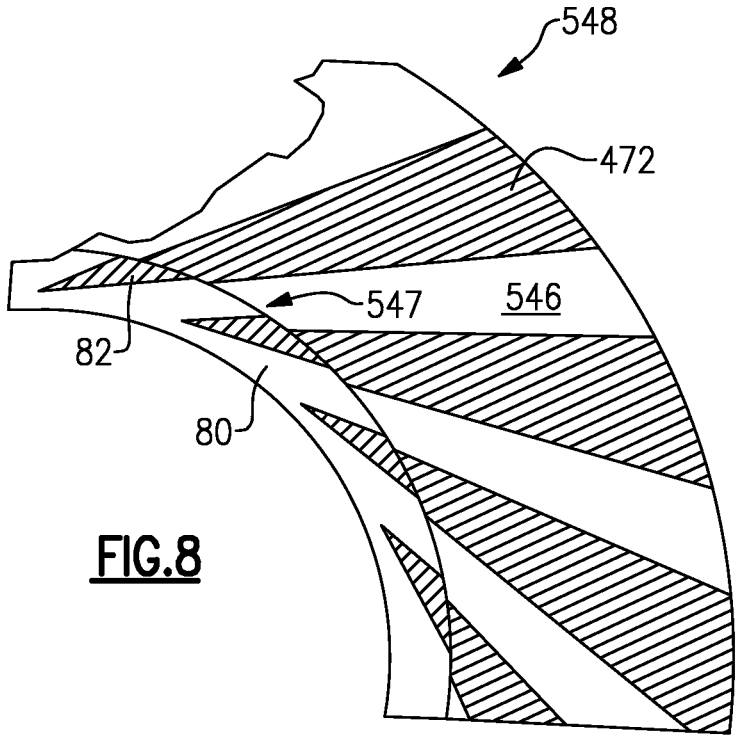
FIG. 8 is a schematic view of a portion of yet another variable geometry arrangement.

Another example variable geometry arrangement 548 is shown in FIG. 8. The vanes 472 include leading edges 82 mounted on a rotatable ring 80 that are movable relative to the rest of the vanes 472 to regulate refrigerant flow through the passages 546. The circumferentially rotatable ring 80 is supported by the housing and is axially aligned with at least a portion of the impeller and arranged radially outward of the outlet end of the impeller. Unlike the embodiments shown in FIGS. 4, 5 and 7, the leading edge of the vane does not provide the throat 547 in all vane positions.

Although example embodiments have been disclosed, a worker of ordinary skill in this art would recognize that certain modifications would come within the scope of the claims. For that reason, the following claims should be studied to determine their true scope and content.

What is claimed is:

1. A refrigerant centrifugal compressor comprising:

a housing providing an inlet, an outlet consisting of a diffuser having a throat area and a volute;

an electric motor provided in the housing and configured to directly drive an impeller via a shaft about an axis in response to a variable speed command, the impeller including an outlet end aligned with a variable geometry diffuser, wherein the variable geometry diffuser includes vanes;

a magnetic bearing assembly configured to rotationally support the shaft relative to the housing in response to a magnetic bearing command;

an actuator;

a variable geometry diffuser member downstream of the impeller receiving a compressor regulation command, wherein the actuator adjusts the position of the variable geometry diffuser member, and wherein the variable geometry diffuser member is configured to at least partially extend into a vane throat between adjacent vanes of the variable geometry diffuser; and a controller in communication with the electric motor, magnetic bearing assembly and the actuator, the controller configured to respectively provide the variable speed command, magnetic bearing command and the compressor regulation command to the electric motor to vary the throat area, magnetic bearing assembly and the actuator to obtain a desired compressor operating condition; and wherein the variable geometry diffuser member is configured to completely surround each vane of the variable geometry diffuser.

2. The refrigerant centrifugal compressor according to claim 1, wherein the variable geometry diffuser member is arranged immediately adjacent to the outlet end of the impeller.

3. The refrigerant centrifugal compressor according to claim 1, wherein the housing includes a vaneless passage upstream of the variable geometry diffuser, the variable geometry diffuser member arranged upstream from the volute.

4. The refrigerant centrifugal compressor according to claim 1, wherein the impeller is a centrifugal impeller with an axial inlet and the outlet end oriented radially.

5. The refrigerant centrifugal compressor according to claim 1, wherein the housing provides a refrigerant inlet upstream from an inlet end of the impeller, the refrigerant inlet is provided without inlet guide vanes.

6. The refrigerant centrifugal compressor according to claim 1, wherein the magnetic bearing assembly includes radially and axially magnetic bearing elements.

7. The refrigerant centrifugal compressor according to claim 1, wherein the variable geometry diffuser member consists of a set of individually rotatable vanes with axes of rotation normal to side walls of the variable geometry diffuser.

8. A control method for a centrifugal compressor comprising:

a housing providing an inlet to an impeller, an outlet from the impeller consisting of a discrete passage diffuser having a throat area and a volute downstream of a variable geometry diffuser, the variable geometry diffuser including a plurality of vanes;

an electric motor provided in the housing and configured to directly drive an impeller via a shaft about an axis in response to a variable speed command, the impeller including an outlet end aligned with a variable geometry diffuser;

an oil-free bearing configured to rotationally support the shaft relative to the housing in response to a magnetic bearing command;

wherein the capacity of the compressor is controlled by adjusting the throat area of the variable geometry diffuser and the pressure ratio is controlled by adjusting the variable speed, wherein the throat area of the variable geometry diffuser is adjusted by moving a variable geometry diffuser member relative to the vanes, and wherein the variable geometry diffuser member extends into a vane throat between adjacent vanes of the variable geometry diffuser; and wherein the variable geometry diffuser member is configured to completely surround each vane of the variable geometry diffuser.

* * * * *